US011579566B2

(12) United States Patent
Kozaki

(10) Patent No.: US 11,579,566 B2
(45) Date of Patent: Feb. 14, 2023

(54) IMAGE FORMING APPARATUS

(71) Applicant: Konica Minolta, Inc., Tokyo (JP)

(72) Inventor: Eriko Kozaki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/355,387

(22) Filed: Jun. 23, 2021

(65) Prior Publication Data

US 2021/0405584 A1 Dec. 30, 2021

(30) Foreign Application Priority Data

Jun. 25, 2020 (JP) ..... JP2020-109498

(51) Int. Cl.
*G03G 21/20* (2006.01)

(52) U.S. Cl.
CPC ..... *G03G 21/206* (2013.01)

(58) Field of Classification Search
None
See application file for complete search history.

(56) References Cited

U.S. PATENT DOCUMENTS 7,941,069 B2 * 5/2011 Idehara ..... G03G 21/206 399/92
2003/0235428 A1 * 12/2003 Suzuki ..... G03G 15/0898 399/107
2007/0140764 A1 * 6/2007 Shirai ..... G03G 21/105 399/358
2008/0205925 A1 * 8/2008 Hatano ..... G03G 15/0898 399/92
2018/0136602 A1 * 5/2018 Hashimura ..... B01D 46/2411
2020/0363769 A1 * 11/2020 Kawabata ..... G03G 21/206

FOREIGN PATENT DOCUMENTS

JP 2006208842 A * 8/2006
JP 2018081217 A 5/2018

* cited by examiner

*Primary Examiner* — Sevan A Aydin
(74) *Attorney, Agent, or Firm* — Cantor Colburn LLP

(57) ABSTRACT

An image forming apparatus includes: a duct that recovers scattered toner and ozone generated in an image former, wherein the duct is partitioned into two parts, one of the partitioned parts is a scattered toner recovery path that recovers the scattered toner, and the other of the partitioned parts is an ozone recovery path that recovers the ozone.

13 Claims, 5 Drawing Sheets

IMAGE FORMING APPARATUS

This present invention claims priority under 35 U.S.C. § 119 to Japanese Patent Application No. 2020-109498, filed on Jun. 25, 2020, the entire content of which is incorporated herein by reference.

BACKGROUND

Technological Field

The present invention relates to an image forming apparatus, and more particularly, to a structure for recovering scattered toner and ozone generated in an image forming apparatus.

Description of the Related Art

As the productivity improves and the linear velocity increases in image forming apparatuses, the amount of scattered toner and the amount of ozone generated per unit time have increased. The image forming apparatus disclosed in JP 2018-081217 A recovers generated scattered toner and ozone through the same path.

Here, in a case where scattered toner and ozone are recovered through the same path, components in the oxidized toner and the ozone may cause a chemical reaction, which may generate an unusual odor. Furthermore, the amounts of scattered toner and ozone generated are different, and the types of required filters are also different, whereby suction power cannot be optimized.

In view of the above, it is conceivable to divide the recovery path of the scattered toner and ozone into separate parts, and to provide them in parallel. In this case, the man-hours and costs for assembling are improved, which requires a large space.

SUMMARY

The present invention has been devised in view of the circumstances described above, and an object thereof is to provide an image forming apparatus capable of reducing man-hours and costs for assembling a structure for recovering scattered toner and ozone, and achieving space saving.

To achieve the abovementioned object, according to an aspect of the present invention, an image forming apparatus reflecting one aspect of the present invention comprises: a duct that recovers scattered toner and ozone generated in an image former, wherein the duct is partitioned into two parts, one of the partitioned parts is a scattered toner recovery path that recovers the scattered toner, and the other of the partitioned parts is an ozone recovery path that recovers the ozone.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments. The same constituent elements will be denoted by the same reference signs, and duplicate description will be omitted.

<Image Forming Apparatus>

Figure 1:
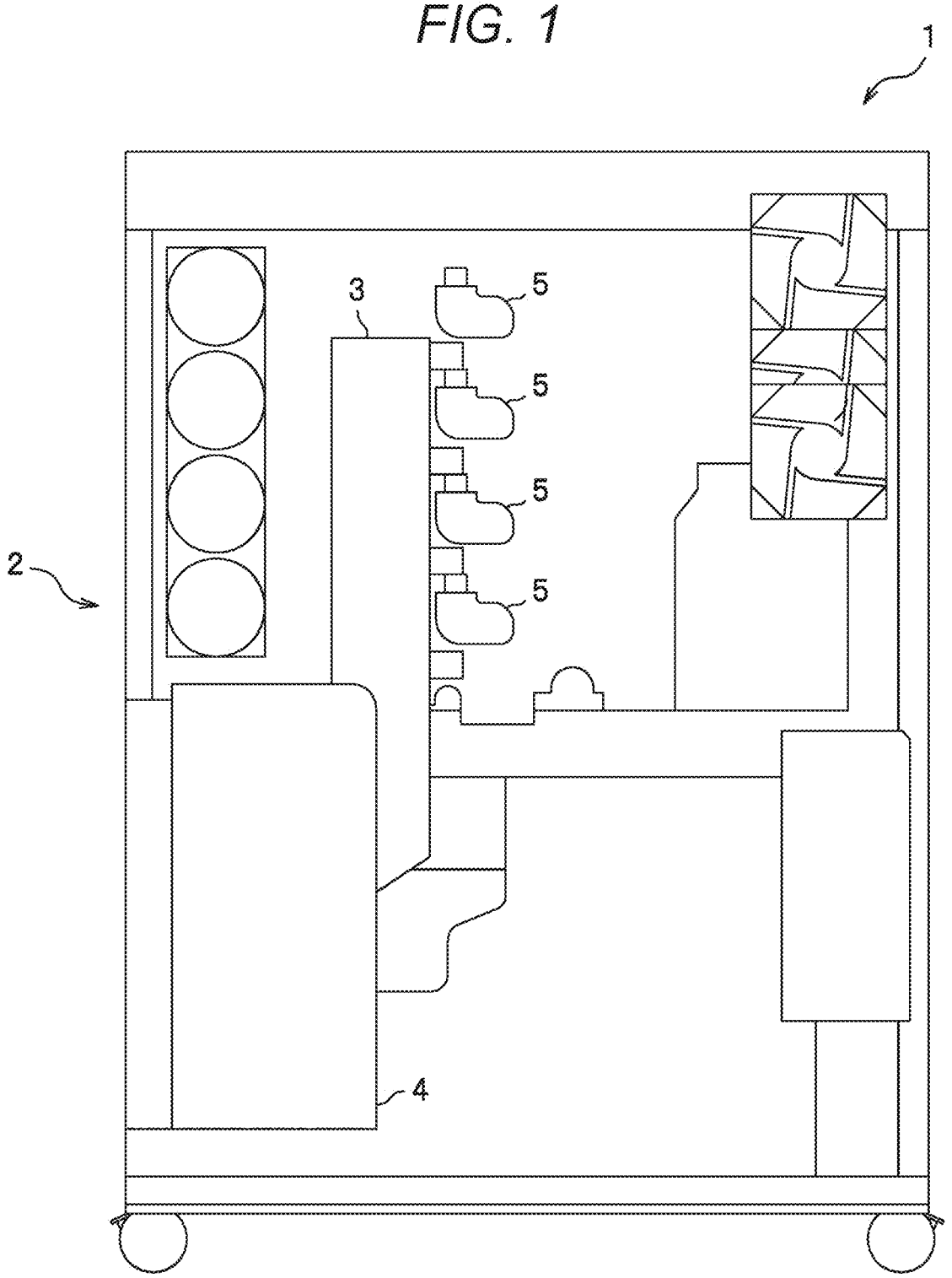
FIG. 1 is a diagram schematically illustrating an internal structure of an image forming apparatus according to an embodiment of the present invention.

As illustrated in FIG. 1, an image forming apparatus 1 according to an embodiment of the present invention is a copying machine that forms a color image by what is called a tandem system, which includes an image forming unit and an image reading unit. The image reading unit optically reads an image from a document placed on platen glass (not illustrated) or a document conveyed by an automatic document feeder (ADF) (not illustrated), and decomposes it into three primary colors of red, green, blue (RGB) to generate color image data.

As illustrated in FIG. 1, (a recovery structure 2 of) the image forming apparatus 1 is a structure for recovering scattered toner and ozone generated in the image forming apparatus 1, and includes a duct 3 and a unit 4. The image forming apparatus 1 includes a plurality of (four in the present embodiment) image formers 5. The image former 5 forms an image on a surface of an object using toner of each color (yellow (Y), magenta (M), cyan (C), and black (K) in order from the upstream side in the conveyance direction of the object). In the present embodiment, the image former 5 includes a photoconductor drum, a charging unit that charges the photoconductor drum, and a developing unit that forms a toner image on the charged photoconductor drum. Here, ozone is generated at the time of charging the photoconductor drum, and scattered toner is generated at the time of forming a toner image on the photoconductor drum.

<Duct>

Figure 2:
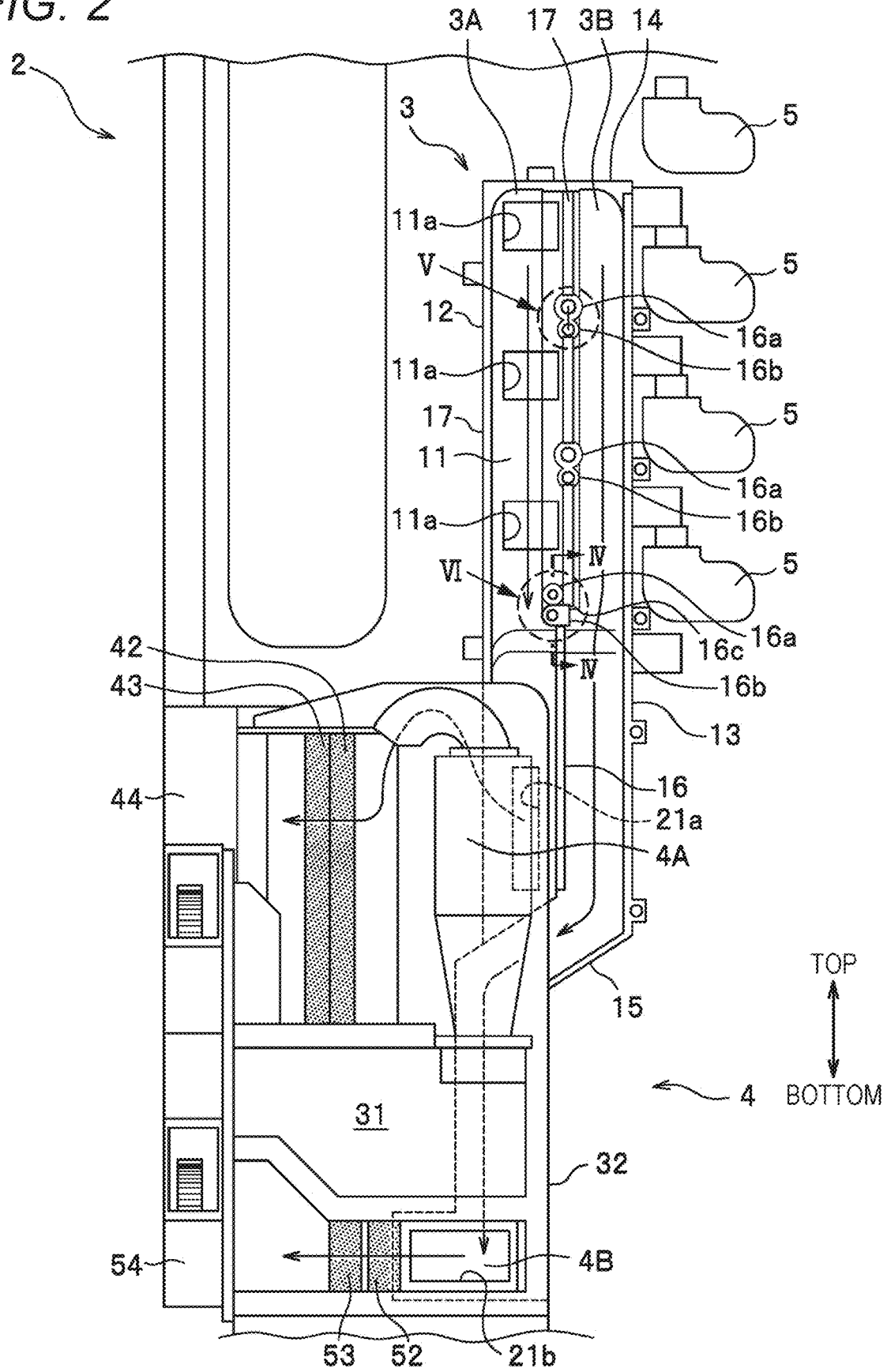
FIG. 2 is a diagram schematically illustrating a recovery structure in an image forming apparatus according to an embodiment of the present invention.

As illustrated in FIG. 2, the duct 3 is provided on the back side in the image forming apparatus 1 to extend in the arrangement direction of the plurality of image formers 5, which is the vertical direction in the present embodiment. Note that, in FIG. 2, outer walls (walls on the front side) of an outer member 20 of the duct 3 and a housing 30 of the unit 4 are omitted to illustrate the internal structures of the duct 3 and the unit 4. The duct 3 includes, inside the duct 3, a scattered toner recovery path 3A (on the upstream side) through which air containing scattered toner flows, and an ozone recovery path 3B (on the upstream side) through which air containing ozone flows. The duct 3 includes a combination of a plurality of parts that are resin members, which is a combination of an inner member 10 and the outer member 20 in the present embodiment. Furthermore, from the viewpoint of avoiding interference with surrounding parts, for example, the downstream side of the duct 3 is bent to be located on the back side of the image forming apparatus 1 rather than the upstream side of the duct 3.

«Inner Member»

Figure 3:
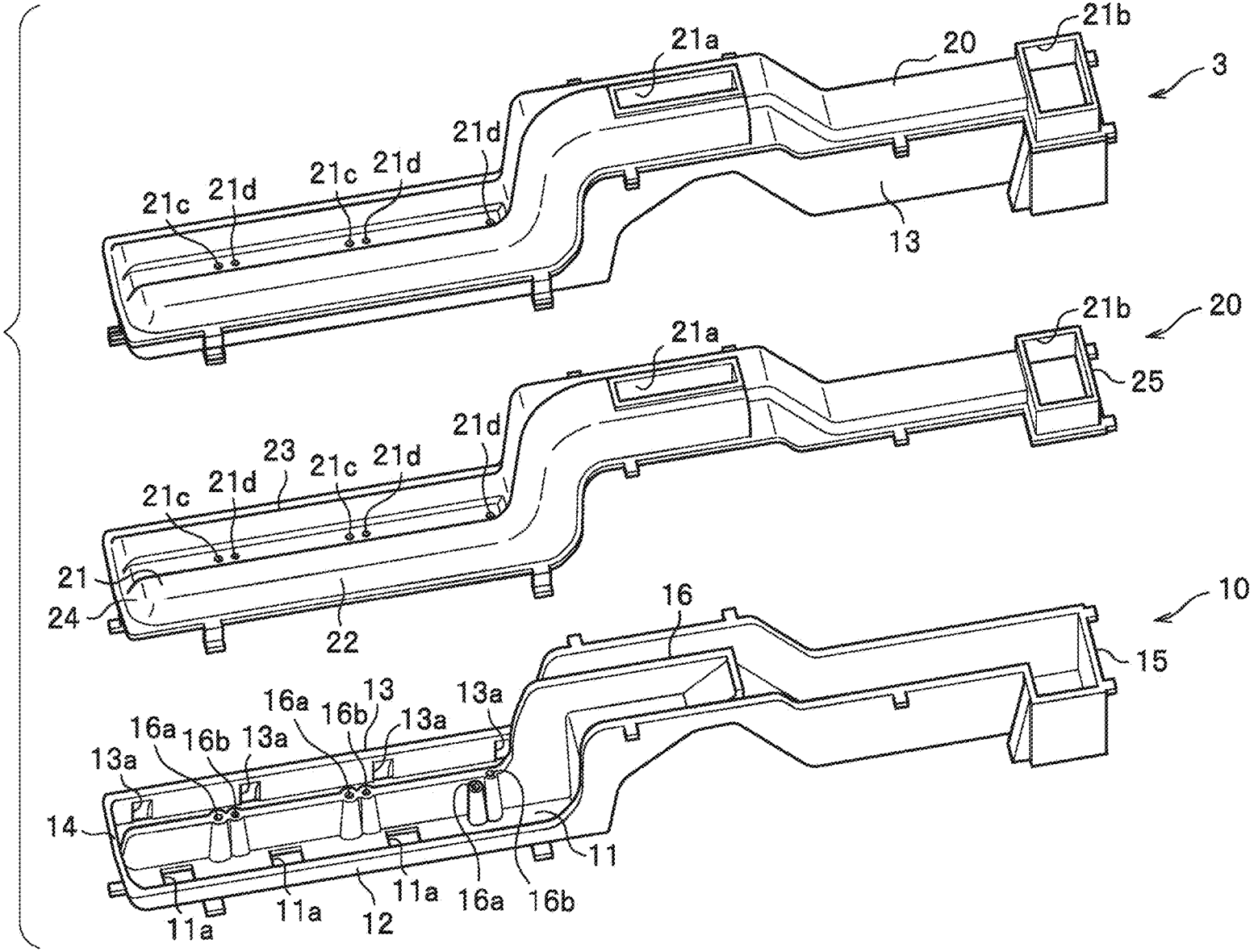
FIG. 3 is a perspective view schematically illustrating a duct according to an embodiment of the present invention.

As illustrated in FIG. 2 and FIG. 3, the inner member 10 integrally includes an inner wall 11 extending in the vertical direction, and a pair of side walls 12 and 13 extending outward (toward the back side) from the end of the inner wall 11 in the width direction. Furthermore, the inner member 10 integrally includes an upper wall 14 extending outward from the upper end of the inner wall 11, and a lower wall 15 extending outward from the lower end of the inner wall 11. Furthermore, the inner member 10 integrally includes a partition wall 16 extending outward (toward the back side) from the intermediate portion of the inner wall 11 in the width direction. Note that, in FIG. 3, the duct 3 illustrated on the left side is configured by assembling the inner member 10 illustrated on the right side and the outer member 20 illustrated in the center to each other.

In the inner wall 11, a plurality of (three in the present embodiment) holes 11*a* is formed between the side wall 12 and the partition wall 16. The hole 11*a* is connected to a portion at which scattered toner is generated in the image former 5. A plurality of (four in the present embodiment) holes 13*a* is formed in the side wall 13. The hole 13*a* is connected to a portion at which ozone is generated in the image former 5.

Figure 4:
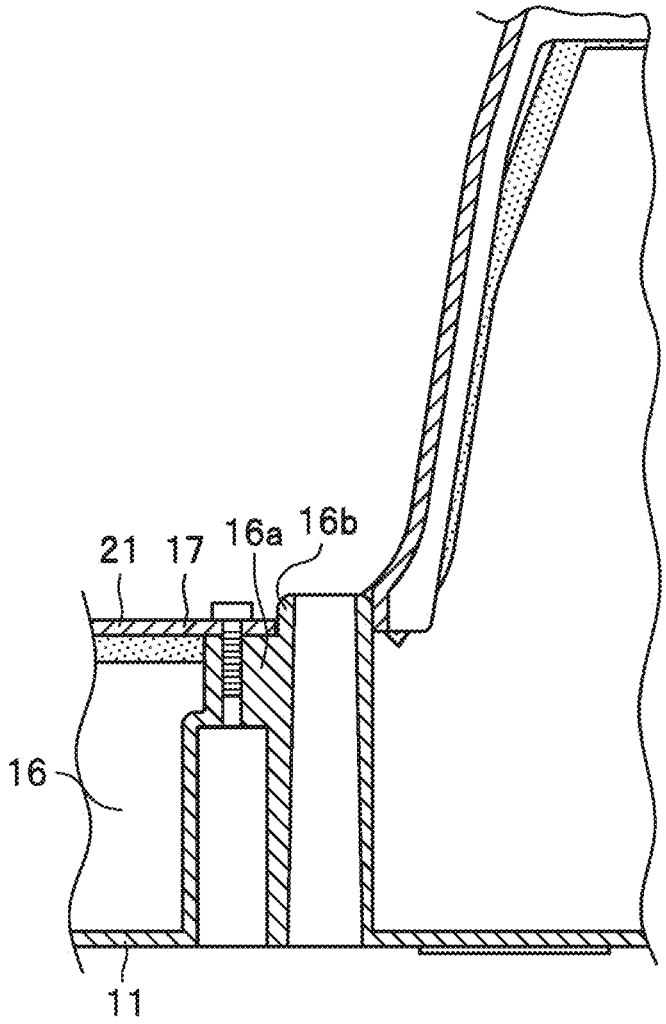
FIG. 4 is a cross-sectional view taken along line IV-IV of FIG. 2.

The partition wall 16 extends, inside the duct 3, in the direction along which the duct 3 extends, and partitions the inside of the duct 3 into the scattered toner recovery path 3A and the ozone recovery path 3B extending in the direction along which the duct 3 extends. The downstream end (lower end) of the partition wall 16 is bent at the intermediate portion of the duct 3 in the flow path direction, and is connected to the side wall 12. At the tip of the partition wall 16, a plurality of sets (three sets in the present embodiment) of screw mounting parts 16*a* and stud shaft mounting parts 16*b* is provided as assembly parts for assembling the inner member 10 and the outer member 20 to each other. The screw mounting part 16*a* is a female screw into which a screw for mounting the outer member 20 to the inner member 10 is screwed. The erection height of the screw mounting part 16*a* is substantially equal to the height at which a seal member 17 is provided at the tip of the partition wall 16 near the hole 16*a* (see FIG. 4). The stud shaft mounting part 16*b* is a part through which a stud shaft to be mounted on another unit of the image forming apparatus 1 through the outer member 20 is inserted. The erection height of the stud shaft mounting part 16*b* is substantially equal to the height at which an outer wall 21 of the outer member 20 is provided at the tip of the partition wall 16 near the hole 16*b* (see FIG. 4).

In the two sets of the screw mounting parts 16*a* and stud shaft mounting parts 16*b* on the upstream side, the outer peripheral surface of the partition wall 16 corresponding to the screw mounting parts 16*a* and stud shaft mounting parts 16*b* has an arc shape protruding in the width direction.

One set of the screw mounting part 16*a* and stud shaft mounting part 16*b* on the downstream side extends toward the side of the scattered toner recovery path 3A of the partition wall 16. The partition wall 16 has a stepped part 16*c* that is displaced toward the side of the scattered toner recovery path 3A between the screw mounting part 16*a* and the stud shaft mounting part 16*b*. That is, the partition wall 16 on the downstream side of the stepped part 16*c* is located on the side of the scattered toner recovery path 3A relative to the partition wall 16 on the upstream side of the stepped part 16*c*.

A flat surface 16*d* connected to the partition wall 16 is provided at the tip of the screw mounting part 16*a* on the downstream side. The flat surface 16*d* protrudes from the tip of the screw mounting part 16*a*, and intersects (in the present embodiment, orthogonal to) the distribution direction of the scattered toner.

Note that an assembly part for assembling the inner member 10 and the outer member 20 to each other may be provided on at least one of the side walls 12 and 13, the upper wall 14, and the lower wall 15.

«Seal Member»

The seal members 17 are provided at the tips of the side walls 12 and 13, the upper wall 14, the lower wall 15, and the partition wall 16. The seal member 17 is made of urethane, for example, which is for airtightly closing the mating surface of the inner member 10 and the outer member 20.

The seal member 17 provided on the partition wall 16 is intermittent at the assembly part, that is, at the screw mounting part 16*a* and the stud shaft mounting part 16*b*.

«Outer Member»

As illustrated in FIG. 3, the outer member 20 integrally includes the outer wall 21 extending in the vertical direction, and a pair of side walls 22 and 23 extending inward (toward the front side) from the end of the outer wall 21 in the width direction. Furthermore, the outer member 20 integrally includes an upper wall 24 extending inward from the upper end of the outer wall 21, and a lower wall 25 extending inward from the lower end of the outer wall 21.

A hole 21*a* is formed at the intermediate portion of the outer wall 21 in the distribution direction, and a hole 21*b* is formed at the downstream end (lower end) of the outer wall 21. The hole 21*a* is for communicating the scattered toner recovery paths 3A and 4A to be described later, and the hole 21*b* is for communicating the ozone recovery paths 3B and 4B to be described later. Furthermore, in the outer wall 21, a hole 21*c* into which a male screw is inserted is formed at a position facing the screw mounting part 16*a*, and a hole 21*d* into which the stud shaft mounting part 16*b* is inserted is formed at a position facing the stud shaft mounting part 16*b*.

Figure 5:
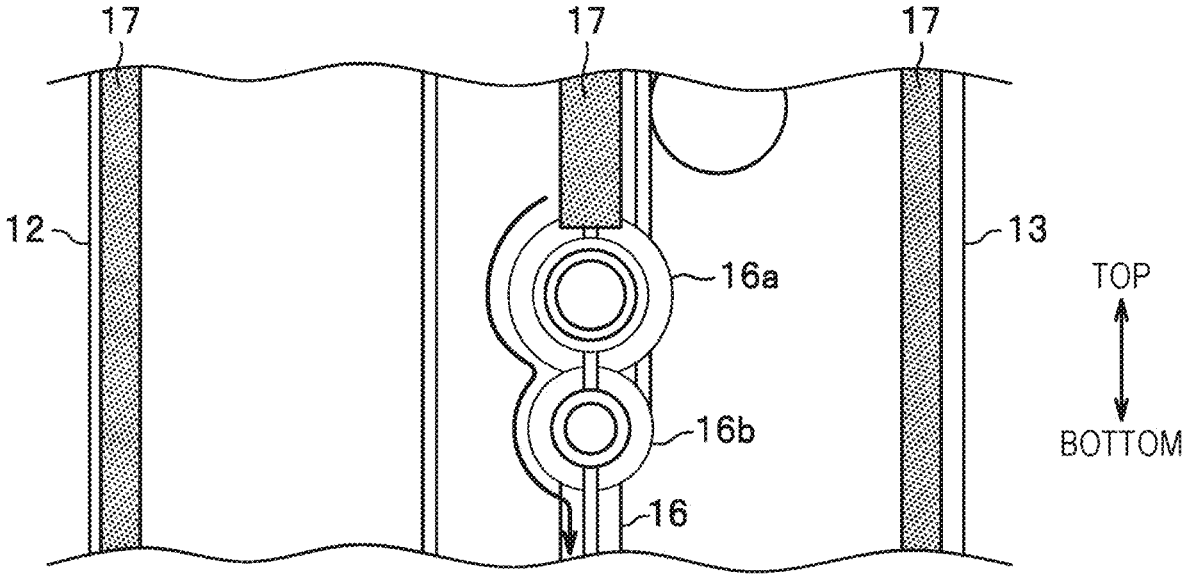
FIG. 5 is an enlarged view of a part V of FIG. 2.
Figure 6:
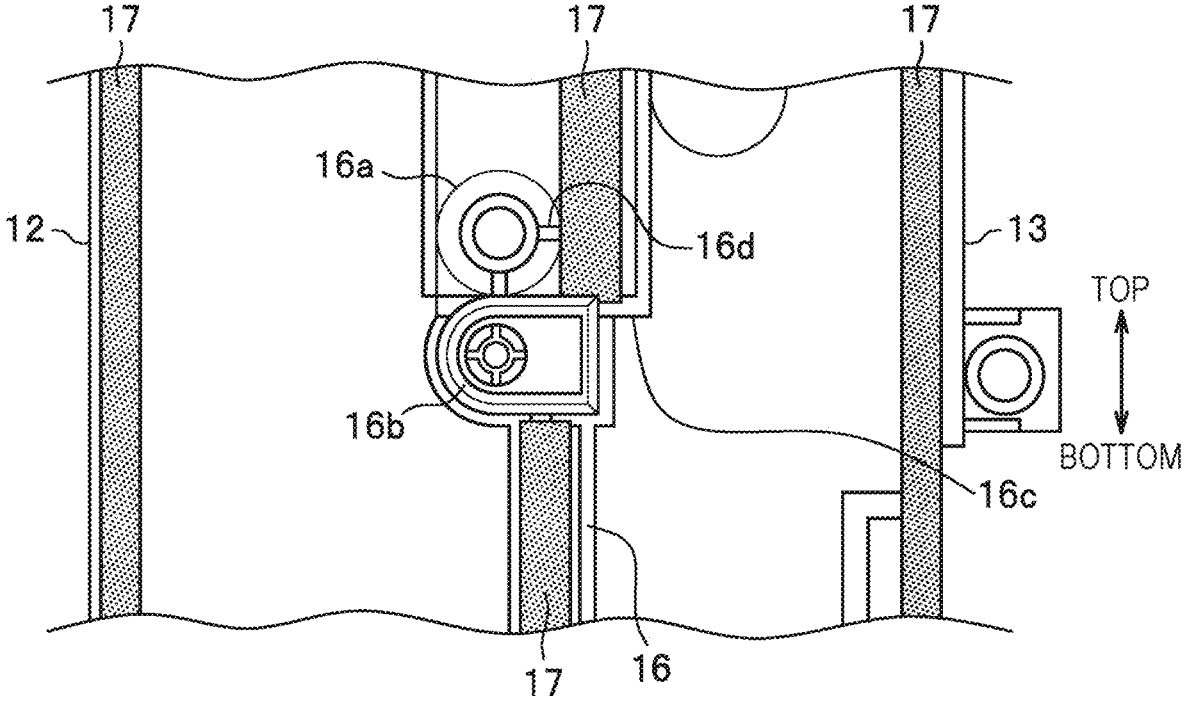
FIG. 6 is an enlarged view of a part VI of FIG. 2.

As illustrated in FIG. 5 and FIG. 6, the tips of the side wall 12 and the side wall 22, the side wall 13 and the side wall 23, the upper wall 14 and the upper wall 24, and the lower wall 15 and the lower wall 25 are airtightly assembled to each other via the seal member 17. Furthermore, the tip of the partition wall 16 is airtightly assembled to the inner surface of the outer wall 21.

As illustrated in FIG. 2, in the duct 3, the scattered toner recovery path 3A through which air containing scattered toner flows is provided on one side (the side of the side walls 12 and 22) of the partition wall 16. The air containing the scattered toner generated in the image forming apparatus 1 flows into the scattered toner recovery path 3A from the plurality of holes 11*a*, and flows toward the unit 4 inside the scattered toner recovery path 3A by operation (suction power) of a fan 44 to be described later.

Furthermore, in the duct 3, the ozone recovery path 3B through which air containing ozone flows is provided on the other side (the side of the side walls 13 and 23) of the partition wall 16.

The air containing ozone generated in the image forming apparatus 1 flows into the ozone recovery path 3B from the plurality of holes 13*a*, and flows toward the unit 4 inside the ozone recovery path 3B by operation (suction power) of a fan 54 to be described later.

Furthermore, in a case where the performance of the fans 44 and 54 to be described later is the same, the air containing ozone has resistance less than that of the air containing scattered toner, whereby the suction power of the ozone recovery path 3B is larger than that of the scattered toner recovery path 3A. Here, in a case where there is a gap in the partition portion between the scattered toner recovery path 3A and the ozone recovery path 3B, the scattered toner may leak to the ozone recovery path 3B. Meanwhile, the duct 3 suppresses such leakage of the scattered toner using the seal member 17 provided on the partition wall 16. Furthermore, the duct 3 suppresses leakage of the scattered toner and the ozone to the outside of the duct 3 using the seal member 17 provided on the mating surface of the inner member 10 and the outer member 20.

Furthermore, as illustrated in FIG. 5, the outer peripheral surfaces of the two sets of the holes 16*a* and 16*b* on the upstream side have arc shapes, whereby the scattered toner flowing inside the scattered toner recovery path 3A flows toward the downstream side without being accumulated on the outer peripheral surfaces of the holes 16*a* and 16*b*. Furthermore, as illustrated in FIG. 6, the flat surface 16*d* provided in the lower hole 16*a* intersects the distribution direction of the scattered toner, and the scattered toner flowing inside the scattered toner recovery path 3A may be partially accumulated on the flat surface 16*d*. Here, in a case where the flat surface 16*d* is provided on the downstream side of the intermittent portion of the seal member 17, the scattered toner accumulated on the flat surface 16*d* may flow back and leak from the intermittent portion of the seal member 17. However, the flat surface 16*d* is provided on the upstream side of the intermittent portion of the seal member 17, whereby leakage of the scattered toner accumulated on the flat surface 16*d* to the side of the ozone recovery path 3B is suppressed.

<Unit>

As illustrated in FIG. 2, the unit 4 is connected to the downstream end of the duct 3. The unit 4 includes a scattered toner recovery path 4A (on the downstream side) through which air containing scattered toner flows, and an ozone recovery path 4B (on the downstream side) through which air containing ozone flows. The unit 4 unitizes and includes the housing 30, a cyclone system 41, filters 42 and 43, and a fan 44 provided in the scattered toner recovery path 4A, and filters 52 and 53 and a fan 54 provided in the ozone recovery path 4B.

«Housing»

The internal space of the housing 30 is partitioned into the upper scattered toner recovery path 4A, the lower ozone recovery path 4B, and a storage 31 therebetween. The scattered toner recovery path 4A is connected to the downstream end of the scattered toner recovery path 3A in the duct 3 via a hole formed in the housing 30 and the hole 21*a* formed in the duct 3. The ozone recovery path 4B is connected to the downstream end of the ozone recovery path 4B in the duct 3 via a hole formed in the housing 30 and the hole 21*b* formed in the duct 3. In the present embodiment, a part of the housing 30 is provided at a position overlapping the downstream end of the duct 3 in a back view. At that portion, the downstream end of the scattered toner recovery path 3A in the duct 3 and the upstream end of the scattered toner recovery path 4A in the unit 4 are connected. Furthermore, at that accommodation portion, the downstream end of the ozone recovery path 3B in the duct 3 and the upstream end of the ozone recovery path 4B in the unit 4 are connected.

«Cyclone System (Scattered Toner Recovery Path)»

The cyclone system 41 is provided on the downstream side of the scattered toner recovery path 3A in the duct 3. The cyclone system 41 is a system in which air containing the scattered toner having passed through the scattered toner recovery path 3A is introduced and the scattered toner is separated from the air using centrifugal force. The scattered toner separated by the cyclone system 41 is stored in the storage 31 provided in the housing 30.

«Filter (Scattered Toner Recovery Path)»

The filters 42 and 43 are provided on the downstream side of the scattered toner recovery path 3A in the duct 3, more specifically, on the downstream side of the cyclone system 41. The filters 42 and 43 remove the scattered toner having failed to be separated by the cyclone system 41.

«Fan (Scattered Toner Recovery Path)»

The fan 44 is provided on the downstream side of the scattered toner recovery path 3A in the duct 3, more specifically, on the downstream side of the filters 42 and 43, which is between the outlet of the scattered toner recovery path 4A outside the housing 30 and the opening of the housing of the image forming apparatus 1. The fan 44 operates under the control of a control unit (not illustrated), and discharges the air inside the scattered toner recovery paths 3A and 4A provided in the duct 3 and the unit 4 to the outside of the housing 30 of the unit 4 and to the outside of the image forming apparatus 1.

«Filter (Ozone Recovery Path)»

The filters 52 and 53 are provided on the downstream side of the ozone recovery path 3B in the duct 3. The filters 52 and 53 remove ozone from the air containing ozone.

«Fan (Ozone Recovery Path)»

The fan 54 is provided on the downstream side of the ozone recovery path 3B in the duct 3, more specifically, on the downstream side of the filters 52 and 53, which is between the outlet of the ozone recovery path 4B outside the housing 30 and the opening of the housing of the image forming apparatus 1. The fan 54 operates under the control of a control unit (not illustrated), and discharges the air inside the ozone recovery paths 3B and 4B provided in the duct 3 and the unit 4 to the outside of the housing 30 of the unit 4 and to the outside of the image forming apparatus 1.

The scattered toner generated in the image former 5 is introduced into, by the suction power of the fan 44, the scattered toner recovery path 3A in the duct 3 through the hole 11*a*. Such scattered toner is sequentially distributed through the scattered toner recovery paths 3A and 4A, separated by the cyclone system 41, and stored in the storage 31. Furthermore, the scattered toner not separated by the cyclone system 41 is collected by the filters 42 and 43.

Furthermore, the ozone generated in the image former 5 is introduced into, by the suction power of the fan 54, the ozone recovery path 3B in the duct 3 through the hole 13*a*. Such ozone sequentially flows through the ozone recovery paths 3B and 4B, and is collected by the filters 52 and 53.

The image forming apparatus 1 according to the embodiment of the present invention includes the duct 3 for recovering the scattered toner and the ozone generated in the image former 5, and the duct 3 is partitioned into two parts, one of which is the scattered toner recovery path 3A for recovering scattered toner and the other is the ozone recovery path 3B for recovering ozone.

Therefore, the image forming apparatus 1 can reduce the man-hours and costs for assembling the structure for recovering the scattered toner and ozone, and can achieve space saving.

The image forming apparatus 1 includes the filters 42 and 43, and 52 and 53 provided on the downstream sides of the scattered toner recovery path 3A and the ozone recovery path 3B, respectively.

Therefore, the image forming apparatus 1 can implement collection suitable for each of the scattered toner recovery and the ozone recovery.

The image forming apparatus 1 includes the fans 44 and 54 provided on the downstream side of the scattered toner recovery path 3A and the ozone recovery path 3B, respectively.

Therefore, the image forming apparatus 1 can achieve the flow rate suitable for each of the scattered toner recovery and the ozone recovery.

The image forming apparatus 1 includes the cyclone system 41, which is provided on the downstream side of the scattered toner recovery path 3A and separates the scattered toner.

Therefore, the image forming apparatus 1 can recover the scattered toner more efficiently.

The image forming apparatus 1 includes the filters 42 and 43, and 52 and 53 provided on the downstream sides of the scattered toner recovery path 3A and the ozone recovery path 3B, respectively, the fans 44 and 54 provided on the downstream sides of the scattered toner recovery path 3A and the ozone recovery path 3B, respectively, and the cyclone system 41 that is provided on the downstream side of the scattered toner recovery path 3A and separates the scattered toner, and the filters 42, 43, 52, and 53, the fans 44 and 54, and the cyclone system 41 are unitized.

Therefore, the image forming apparatus 1 can achieve efficiency in assembling the duct 3 and the unit.

In the image forming apparatus 1, the cyclone system 41, the filters 42 and 43, and the fan 44 are arranged in that order from the side of the duct 3 on the downstream side of the scattered toner recovery path 3A, and the filters 52 and 53 and the fan 54 are arranged in that order from the side of the duct 3 on the downstream side of the ozone recovery path 3B.

Therefore, the image forming apparatus 1 can recover scattered toner and ozone on the upstream side of each of the fans 44 and 54, whereby contamination of each of the fans 44 and 54 due to the scattered toner and ozone can be suppressed.

In the image forming apparatus 1, the duct 3 extends in the arrangement direction of the plurality of image formers 5.

Therefore, the image forming apparatus 1 can efficiently recover the scattered toner and ozone, and can achieve space saving of the duct 3.

In the image forming apparatus 1, the duct 3 includes a plurality of parts.

Therefore, flexibility in designing the duct 3 can be improved in the image forming apparatus 1.

In the image forming apparatus 1, one of the parts is provided with the partition wall 16 that partitions the scattered toner recovery path 3A and the ozone recovery path 3B, and a seal (seal member 17) is provided on the mating part between the partition wall 16 and another of the parts.

Therefore, entrance of scattered toner into the ozone recovery path 3B can be suppressed in the image forming apparatus 1.

In the image forming apparatus 1, a seal (seal member 17) is provided on the mating part of the plurality of parts.

Therefore, the image forming apparatus 1 can suppress entrance of scattered toner into the ozone recovery path 3B, and can suppress leakage of scattered toner and ozone to the outside of the duct 3.

In the image forming apparatus 1, one of the parts is provided with an assembly part for assembling to another of the parts adjacent to the partition wall 16 that partitions the scattered toner recovery path 3A and the ozone recovery path 3B, and the partition wall 16 has, at a part adjacent to the assembly part, the stepped part 16*c* bent in the arrangement direction of the scattered toner recovery path 3A and the ozone recovery path 3B.

Therefore, in the image forming apparatus 1, the duct 3 can be formed not to interfere with surrounding parts while ensuring the cross-sectional area of the scattered toner recovery path 3A and/or the ozone recovery path 3B in the distribution direction.

One of the parts is provided with an assembly part for assembling to another of the parts on the partition wall 16 for partitioning the scattered toner recovery path 3A and the ozone recovery path 3B or adjacent to the partition wall 16, and the surface of the assembly part on the side of the scattered toner recovery path 3A, which can be seen from the upstream side of the scattered toner recovery path 3A, has a shape protruding toward the scattered toner recovery path 3A as it goes toward the downstream side.

Therefore, the image forming apparatus 1 can suppress accumulation of scattered toner on the side surface of the assembly part, whereby it becomes possible to suppress entrance of the accumulated scattered toner into the ozone recovery path 3B.

In the image forming apparatus 1, one of the parts is provided with an assembly part for assembling to another of the parts on the partition wall 16 for partitioning the scattered toner recovery path 3A and the ozone recovery path 3B or adjacent to the partition wall 16, the assembly part has a flat surface 16*d* on the side of the scattered toner recovery path 3A, the flat surface intersecting the distribution direction of the scattered toner when viewed from the erection direction of the partition wall 16, a seal (seal member 17) intermittent in the assembly part is provided on the mating part between the partition wall 16 and another of the parts, and the flat surface 16*d* is provided on the upstream side of the intermittent part of the seal in the distribution direction of the scattered toner.

Therefore, entrance of the scattered toner accumulated on the flat surface 16*d* into the ozone recovery path 3B can be suppressed in the image forming apparatus 1.

Note that the structure can also be adopted in a case where the flat surface 16*d* is a surface (flat surface or curved surface) toward the side of the ozone recovery path 3B as it goes toward the downstream side when viewed from the upstream side of the scattered toner recovery path 3A.

Although embodiments of the present invention have been described and illustrated in detail, the disclosed embodiments are made for purposes of illustration and example only and not limitation, and may be appropriately modified without departing from the gist of the present invention. The scope of the present invention should be interpreted by terms of the appended claims. For example, the duct 3 is not limited to the combination of two parts, and may be a combination of three or more parts. Furthermore, it is sufficient if the side surface of the assembly part on the side of the scattered toner recovery path 3A has a surface seen from the upstream side of the scattered toner having a shape protruding toward the side of the scattered toner recovery path 3A as it goes toward the downstream side (i.e., shape directed toward the downstream side as it goes toward the inside of the scattered toner recovery path 3A). According to such a shape, accumulation of scattered toner on the side surface can be suppressed.

What is claimed is:

1. An image forming apparatus comprising:

a duct that recovers scattered toner and ozone generated in an image former, wherein the duct is partitioned into two parts, one of the partitioned parts is a scattered toner recovery path that recovers the scattered toner, and the other of the partitioned parts is an ozone recovery path that recovers the ozone;

wherein the toner recovery path and the ozone recovery path are defined by a common wall that separates the toner recovery path from the ozone recovery path;

wherein the toner recovery path includes a plurality of toner inlets arranged along the toner recovery path to admit scattered toner into the toner recovery path; and wherein the ozone recovery path includes a plurality of ozone inlets arranged along the ozone recovery path to admit recovered ozone into the ozone recovery path.

2. The image forming apparatus according to claim 1, further comprising:

a first filter provided on a downstream side of the scattered toner recovery path; and a second filter provided on a downstream side of the ozone recovery path.

3. The image forming apparatus according to claim 1, further comprising:

a first fan provided on a downstream side of the scattered toner recovery path; and a second fan provided on a downstream side of the ozone recovery path.

4. The image forming apparatus according to claim 1, further comprising:

a cyclone system that is provided on a downstream side of the scattered toner recovery path and separates the scattered toner.

5. The image forming apparatus according to claim 1, further comprising:

a first filter provided on a downstream side of the scattered toner recovery path;

a second filter provided on a downstream side of the ozone recovery path;

a first fan provided on the downstream side of the scattered toner recovery path;

a second fan provided on the downstream side of the ozone recovery path; and a cyclone system that is provided on the downstream side of the scattered toner recovery path and separates the scattered toner, wherein the first filter, the first fan, and the cyclone system are unitized.

6. The image forming apparatus according to claim 5, wherein on the downstream side of the scattered toner recovery path, the cyclone system, the first filter, and the first fan are arranged in the order from a side of the duct, and on the downstream side of the ozone recovery path, the second filter and the second fan are arranged in the order from the side of the duct.

7. The image forming apparatus according to claim 1, wherein the duct extends in an arrangement direction of a plurality of the image formers.

8. The image forming apparatus according to claim 1, wherein the duct includes a plurality of parts.

9. The image forming apparatus according to claim 8, wherein one of the parts is provided with a partition wall that partitions the scattered toner recovery path and the ozone recovery path, and a seal is provided on a mating part between the partition wall and another of the parts.

10. The image forming apparatus according to claim 8, wherein a seal is provided on a mating part of the plurality of parts.

11. The image forming apparatus according to claim 8, wherein one of the parts is provided with an assembly part for assembling to another of the parts, the assembly part being adjacent to a partition wall that partitions the scattered toner recovery path and the ozone recovery path, and the partition wall has, at a part adjacent to the assembly part, a stepped part bent in an arrangement direction of the scattered toner recovery path and the ozone recovery path.

12. The image forming apparatus according to claim 8, wherein one of the parts is provided with an assembly part for assembling to another of the parts, the assembly part being on or adjacent to a partition wall that partitions the scattered toner recovery path and the ozone recovery path, and a surface of the assembly part on a side of the scattered toner recovery path, which can be seen from an upstream side of the scattered toner recovery path, has a shape protruding toward the scattered toner recovery path as the surface goes toward a downstream side.

13. The image forming apparatus according to claim 8, wherein one of the parts is provided with an assembly part for assembling to another of the parts, the assembly part being on or adjacent to a partition wall that partitions the scattered toner recovery path and the ozone recovery path, the assembly part has a flat surface on a side of the scattered toner recovery path, the flat surface intersecting a distribution direction of the scattered toner when viewed from an erection direction of the partition wall, a seal intermittent in the assembly part is provided on a mating part between the partition wall and another of the parts, and the flat surface is provided on an upstream side of the intermittent part of the seal in the distribution direction of the scattered toner.

* * * * *